US008899934B2

(12) United States Patent
Hirata et al.

(10) Patent No.: US 8,899,934 B2
(45) Date of Patent: Dec. 2, 2014

(54) ROTOR STRUCTURE

(75) Inventors: Tomoyuki Hirata, Tokyo (JP); Kazuharu Hirokawa, Tokyo (JP); Yoshimasa Takaoka, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 325 days.

(21) Appl. No.: 13/362,629

(22) Filed: Jan. 31, 2012

(65) Prior Publication Data

US 2012/0251329 A1 Oct. 4, 2012

(30) Foreign Application Priority Data

Mar. 17, 2011 (JP) ..... P2011-059706

(51) Int. Cl.
*F01D 5/32* (2006.01)
*F04D 29/32* (2006.01)
*F01D 5/30* (2006.01)

(52) U.S. Cl.
CPC ..... *F04D 29/322* (2013.01); *F01D 5/3038* (2013.01); *F01D 5/32* (2013.01)
USPC ..... 416/215; 416/220 R

(58) Field of Classification Search
USPC ..... 416/215, 220 R, 204 A, 248, 219 R
See application file for complete search history.

(56) References Cited

U.S. PATENT DOCUMENTS

| | | | | |
|---|---|---|---|---|
| 3,216,700 | A | 11/1965 | Bostock, Jr. | |
| 5,522,706 | A | 6/1996 | Mannava et al. | |
| 6,464,463 | B2 * | 10/2002 | Yvon Goga et al. | 416/215 |
| 2003/0123986 | A1 * | 7/2003 | Antunes et al. | 416/220 R |

FOREIGN PATENT DOCUMENTS

| | | | |
|---|---|---|---|
| GB | 2 156 908 | A | 10/1985 |
| JP | 03-025801 | U | 3/1991 |
| JP | 03-045402 | U | 4/1991 |
| JP | 2002-21504 | A | 1/2002 |

OTHER PUBLICATIONS

Written Opinion of the International Searching Authority dated May 1, 2012, issued in International Application No. PCT/JP2012/052054, with English translation (4 pages).
International Search Report of PCT/JP2012/052054, date of mailing May 1, 2012, with English translation (5 pages).

* cited by examiner

*Primary Examiner* — Edward Look
*Assistant Examiner* — Maxime Adjagbe
(74) *Attorney, Agent, or Firm* — Westerman, Hattori, Daniels & Adrian, LLP

(57) ABSTRACT

The rotor structure is provided with a rotation shaft body in which a blade groove is formed at an outer circumference part, and extends in a circumferential direction of the axis line, and a plurality of blade bodies which are arrayed in the circumferential direction at the outer circumference part of the rotation shaft body, wherein a blade fixing piece is installed so as to be a positioned between at least one set of adjacent two blade bodies in the circumferential direction inside the blade groove, a projected part is formed at where either an opening wall part or the groove opening side of the blade groove and the blade fixing piece, and a recessed part which is fitted into the projected part is formed at where the other one of them.

8 Claims, 12 Drawing Sheets

ROTOR STRUCTURE

BACKGROUND OF THE INVENTION

1. Field of the Invention

The present invention relates to a rotor structure. Priority is claimed on Japanese Patent Application No. 2011-059706 filed on Mar. 17, 2011 the entire content of which is incorporated herein by reference.

2. Description of Related Art

As is well known, in a rotary machine, typical examples of which are a compressor and a turbine, a rotor having a plurality of moving blades arrayed on an outer circumference of a rotation shaft body in a circumferential direction is used.

For example, in Japanese Published Unexamined Utility Model Application, First Publication No. Hei-3-25801, a structure such that many moving blades are embedded in a blade groove bored on an outer circumference in a circumferential direction of a rotor of a rotary machine is adapted. In Japanese Published Unexamined Utility Model Application, First Publication No. Hei-3-25801, a blade fixing piece is fitted between the blade basements of adjacent two moving blades. Then, in Patent Document 1, a bolt is screwed into a threaded hole formed at the center in a radial direction of the blade fixing piece. On the other hand, a round hole is bored on a bottom face of the blade groove, and a lower end of the bolt is fitted into the round hole, thereby restricting displacement of the moving blades in a circumferential direction.

However, in the conventional technology, an inner wall part of the round hole is a structurally discontinuous part. Thus, stress concentrates in the vicinity of the round hole and cracks may occur.

SUMMARY OF THE INVENTION

The present invention has been made in view of the above-described situation, an object of which is to provide a rotor structure which prevents the occurrence of cracks on a groove bottom of a blade groove.

In order to attain the above object, the present invention has adopted the following means.

According to a first aspect of the present invention, a rotor structure includes a rotation shaft body in which a blade groove is formed at an outer circumference part rotating around an axis line and extends in a circumferential direction of the axis line, and a width dimension of a groove opening side of the blade groove is set to be smaller than a width dimension of a groove bottom side of the blade groove, and a plurality of blade bodies which are arrayed at the outer circumference part of the rotation shaft body in the circumferential direction and have blade basements of which is fitted into the blade groove respectively. In the rotor structure, a blade fixing piece is installed so as to be positioned between at least one set of adjacent two blade bodies in the circumferential direction inside the blade groove, and one of an opening wall part of the groove opening side of the blade groove and the blade fixing piece is provided with a projected part, and the other of them is provided with a recessed part which is fitted into the projected part.

In the rotor structure according to the first aspect of the present invention, one of an opening wall part of the groove opening side of the blade groove and the blade fixing piece is provided with the projected part, while the other of them is provided with the recessed part which is fitted into the projected part. Thus, a relative displacement of the blade body with respect to the blade groove in the circumferential direction is restricted by interference of the projected part with the recessed part. Thereby, stress is hard to concentrate on the groove bottom of the blade groove, thus making it possible to avoid cracks on the groove bottom of the blade groove.

In a conventional rotor structure, when a crack occurs on a groove bottom of a blade groove in a state when a blade body is assembled to a rotation shaft body, it is difficult to find the crack during ordinary maintenance and inspection. As a result, the crack may progress excessively or break the rotation shaft body, which may require stopping operation of an apparatus having the rotation shaft body. Further, even when a crack occurring on the groove bottom of the blade groove is found, it is difficult to repair the blade body being assembled unless it is detached. Thus, the conventional rotor structure is also inferior in maintainability.

However, as described above, with the rotor structure according to the first aspect of the present invention, there is no possibility that a crack occurs on the groove bottom of the blade groove. Further, if a crack has occurred on the opening wall part of the blade groove, the site of the crack is positioned on the surface of the rotation shaft body. Thus, the crack can be found easily. As a result, it is possible to prevent breakage of the rotation shaft body resulting from the crack. It is, thereby, possible to operate stably and continuously an apparatus having the rotation shaft body. Still further, since the site of the crack occurs on the surface of the rotation shaft body, repairs can be done relatively easily.

According to a second aspect of the present invention, the blade fixing piece is allowed to slide in the circumferential direction of the blade groove in a state of fitting of the projected part into the recessed part is cancelled.

In the rotor structure according to the second aspect of the present invention, the blade fixing piece is allowed to slide in the circumferential direction of the blade groove in a state of fitting of the projected part into the recessed part is cancelled. Thus, when the blade body and the blade fixing piece are assembled to the rotation shaft body, a piece main body can be caused to slide on the groove bottom of the blade groove and arranged at a desired position.

Thereby, it is possible to improve workability on assembling the blade body and the blade fixing piece to the rotation shaft body.

According to a third aspect of the present invention, the projected part projects in a radial direction of the axis line and the recessed part extends in the radial direction.

In the rotor structure according to the third aspect of the present invention, the projected part which projects in the radial direction is fitted into the recessed part which extends in the radial direction. It is, thereby, possible to reliably restrict the blade fixing member in the circumferential direction.

According to a fourth aspect of the present invention, the blade fixing piece includes a piece main body on which the projected part or the recessed part is formed, and a displacement mechanism which causes the piece main body to advance and retract with respect to the groove bottom of the blade groove in the radial direction of the axis line to allow the projected part to removably fit to the recessed part.

In the rotor structure according to the fourth aspect of the present invention, a displacement mechanism is configured to cause the piece main body on which the projected part or the recessed part is formed to move forward and retract with respect to the groove bottom of the blade groove to allow the projected part to removably fit to the recessed part. Thus, the projected part can be removably fitted to the recessed part easily and accurately. It is, thereby, possible to improve workability when the blade body and the blade fixing piece are assembled to the rotation shaft body.

According to a fifth aspect of the present invention, the displacement mechanism is provided with a through hole which penetrates through the piece main body in the radial direction and has at least partially an internal thread part and an advance-retract axle which has at least partially an external thread part screwed with the internal thread part and can be screwed into the groove bottom of the blade groove.

In the rotor structure according to the fifth aspect of the present invention, the advance-retract axle can be screwed into the groove bottom of the blade groove. Therefore, the piece main body is caused to move advance and retract relative to the groove bottom of the blade groove accurately and easily in a relatively simple constitution.

According to a sixth aspect of the present invention, an end face of the advance-retract axle that faces the groove bottom of the blade groove swells out to the groove bottom of the blade groove.

In the rotor structure according to the sixth aspect of the present invention, the end face of the advance-retract axle swells out to the groove bottom of the blade groove.

Therefore, the end face of the advance-retract axle can be caused to make a point contact with the groove bottom of the blade groove. The end face of the advance-retract axle is, thereby, prevented from making partial contact with the groove bottom of the blade groove and reliably caused to make a point contact therewith. As a result, the piece main body can be caused to more reliably move advance and retract relative to the groove bottom of the blade groove.

According to a seventh aspect of the present invention, the blade fixing piece includes a contact part which is in contact with the opening wall part of the blade groove from the groove bottom of the blade groove.

In the rotor structure according to the seventh aspect of the present invention, the blade fixing piece includes the contact part which is in contact with the opening wall part of the blade groove from the groove bottom of the blade groove. Therefore, it is possible to successfully restrict the blade fixing piece in the radial direction.

According to an eighth aspect of the present invention, the blade fixing piece is provided with a projection wall as the projected part which projects in the radial direction of the axis line at least one side in the width direction of the blade groove, and the opening wall part of the blade groove is provided with a notch as the recessed part which extends in the radial direction at least one side in the width direction of the blade groove.

In the rotor structure according to the eighth aspect of the present invention, the blade fixing piece is provided with the projection wall, and the opening wall part of the blade groove is provided with the notch. It is, thus, possible to avoid the occurrence of cracks on the groove bottom of the blade groove in a relatively simple constitution.

According to a ninth aspect of the present invention, the blade fixing piece is provided with a screw member as the projected part which projects in the radial direction of the axis line at least one side in the width direction of the blade groove, and the opening wall part of the blade groove is provided with a notch as the recessed part which extends in the radial direction at least one side in the width direction of the blade groove.

In the rotor structure according to the ninth aspect of the present invention, the blade fixing piece is provided with the screw member, and the opening wall part of the blade groove is provided with the notch. Therefore, it is possible to avoid the occurrence of cracks on the groove bottom of the blade groove in a relatively simple constitution. It is also possible to meet various design requirements.

In the rotor structure according to these aspects of the present invention, it is possible to prevent the occurrence of cracks on the groove bottom of the blade groove.

DETAILED DESCRIPTION OF THE INVENTION

Hereinafter, a description will be given for embodiments of the present invention by referring to drawings.

[First Embodiment]

Figure 1:
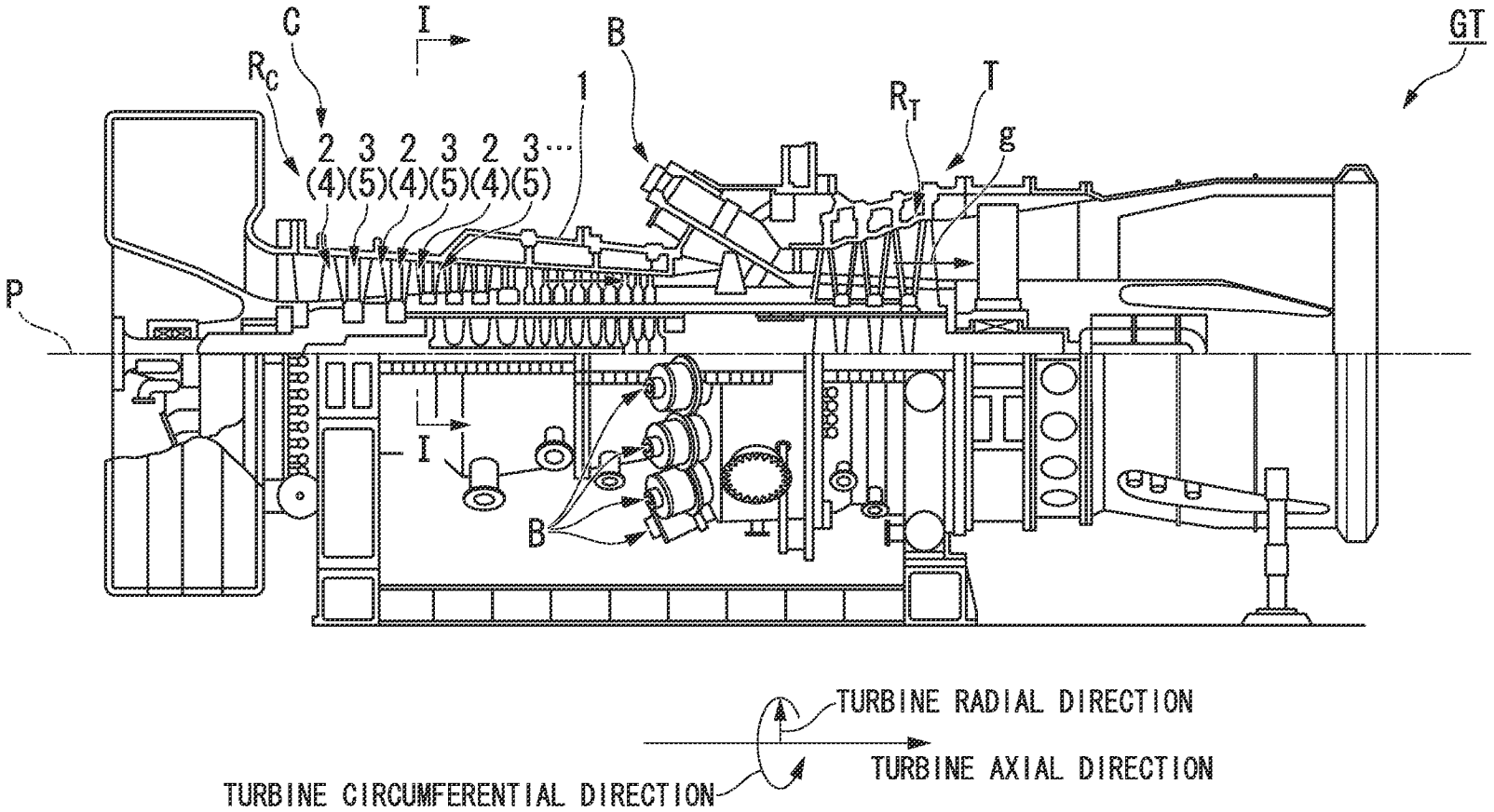
FIG. 1 is a half cross-sectional diagram which shows a brief constitution of a gas turbine GT according to a first embodiment of the present invention.

FIG. 1 is a half cross-sectional diagram which shows a brief constitution of the gas turbine GT according to the first embodiment of the present invention. As shown in FIG. 1, the gas turbine GT is provided with a compressor C, a plurality of combustors B and a turbine T. The compressor C produces compressed air c. The combustor B supplies a fuel to the compressed air c supplied from the compressor C to produce a combustion gas g. The turbine T obtains rotation power from the combustion gas g supplied from the combustor B.

In the gas turbine GT, a rotor $R_C$ of the compressor C and a rotor $R_T$ of the turbine T are coupled to the respective axial ends and extend taken along a turbine shaft (axis line) P.

In the following description, a direction at which the turbine shaft P extends is referred to as "turbine axial direction" or "axial direction." A circumferential direction of the turbine shaft P is referred to as "turbine circumferential direction" or "circumferential direction." A radial direction of the turbine shaft P is referred to as "turbine radial direction" or "radial direction."

The compressor C is provided with a stator blade array 2 and a moving blade array 3. The stator blade array 2 and the moving blade array 3 are alternately disposed inside a compressor casing 1 in the turbine axial direction. The stator blade array 2 and the moving blade array 3 are counted in set of a pair as one stage.

The stator blade array 2 of each stage is installed by being fixed to the compressor casing 1 side. Then, the stator blade array 2 of each stage is structured such that a plurality of stator blades 4 extending from the compressor casing 1 to the rotor $R_C$ side are arrayed annularly in the turbine circumferential direction.

The moving blade array 3 of each stage is installed by being fixed to the rotor $R_C$ side. Then, the moving blade array 3 of each stage is structured such that a plurality of moving blades 5 extending from the rotor $R_C$ side to the compressor casing 1 side are arrayed annularly in the turbine circumferential direction.

Figure 2:
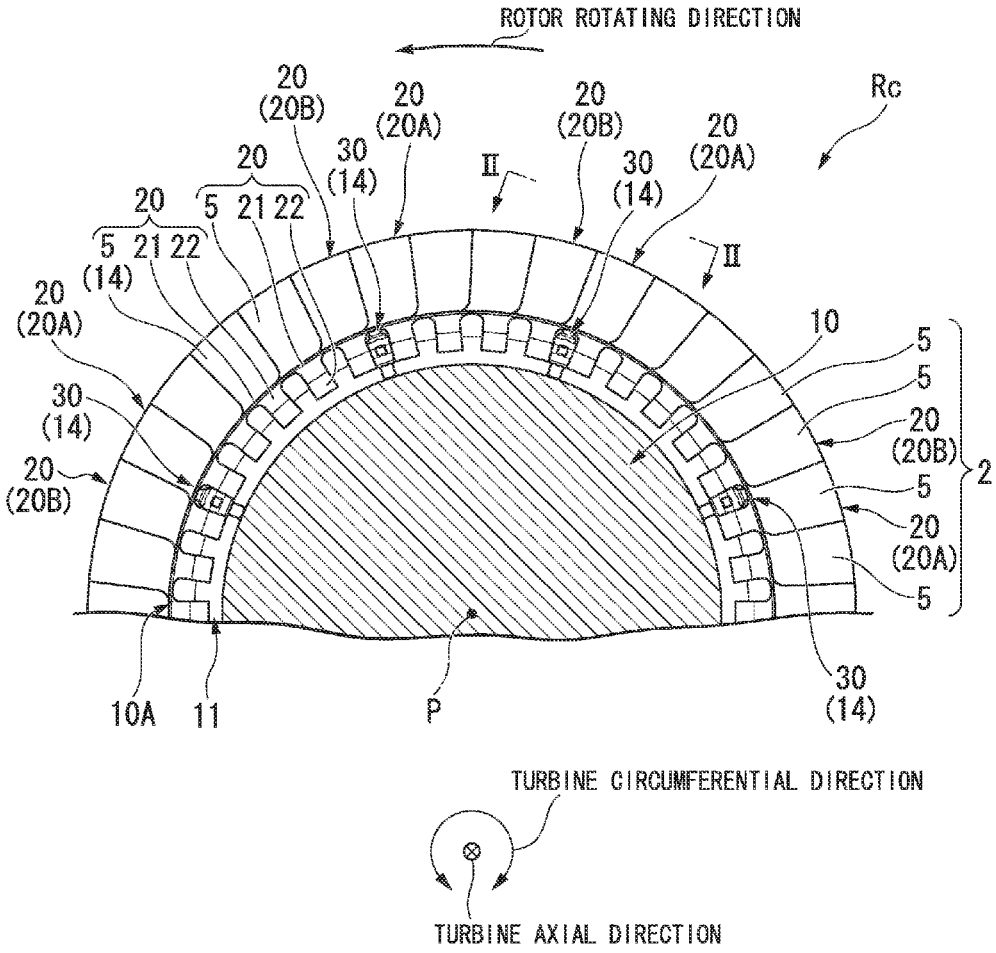
FIG. 2 is a cross-sectional diagram taken along the line I to I of FIG. 1 in the first embodiment of the present invention.
Figure 3:
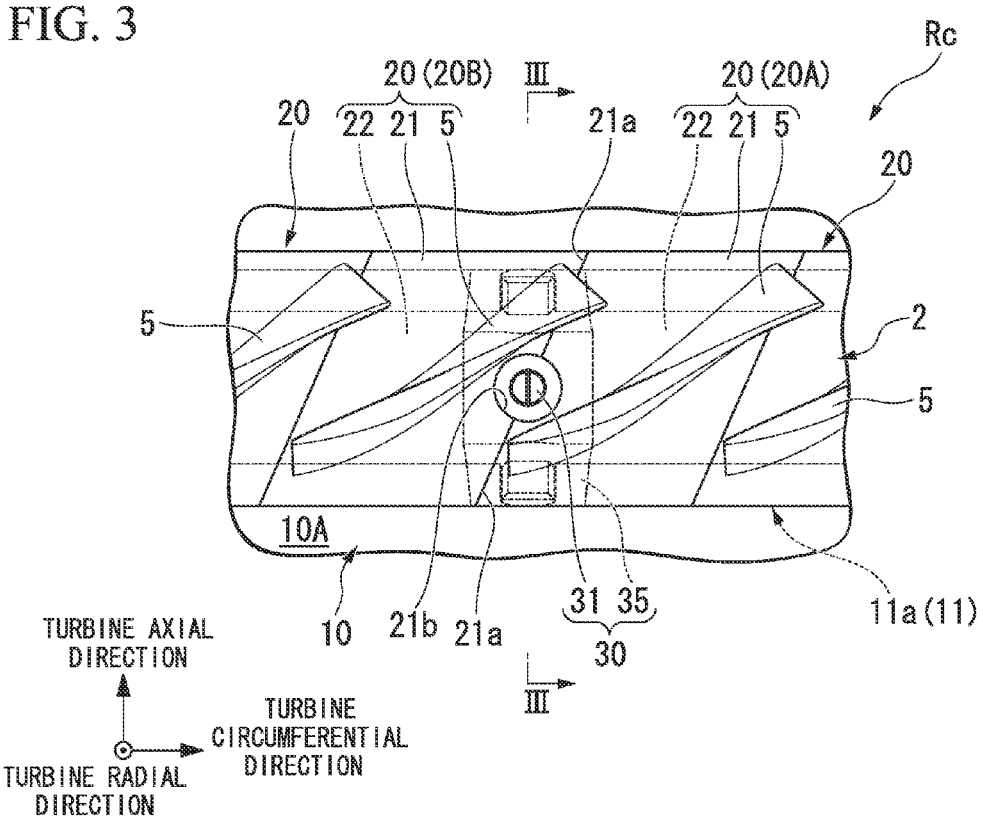
FIG. 3 is an arrow diagram taken along the arrow II to II of FIG. 2 in the first embodiment of the present invention.
Figure 4:
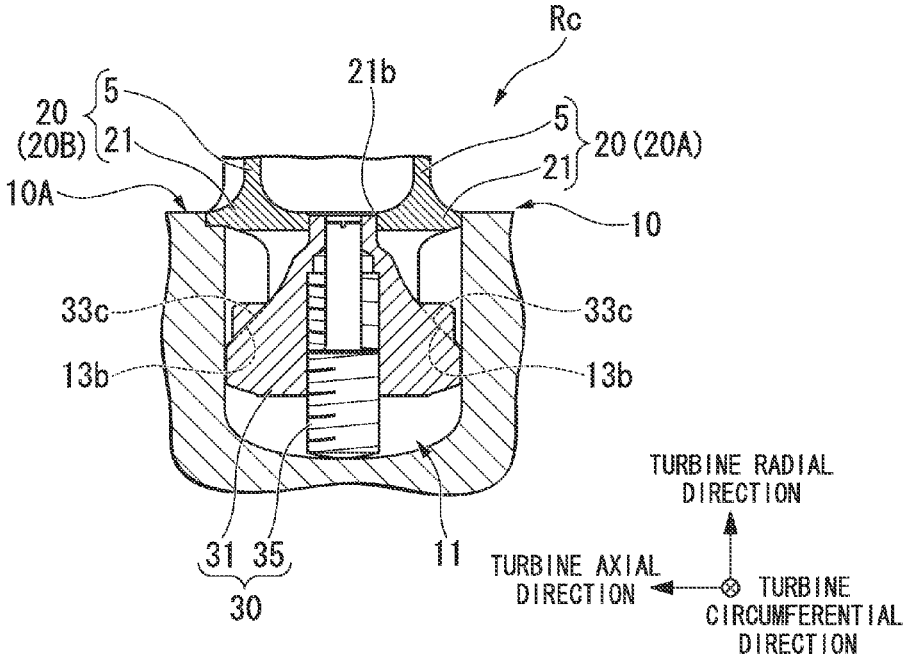
FIG. 4 is a cross-sectional diagram taken along the line III to III of FIG. 3 in the first embodiment of the present invention.

FIG. 2 is a cross-sectional diagram taken along the line I to I of FIG. 1. FIG. 3 is an arrow diagram on arrow of line II to II in FIG. 2. FIG. 4 is a cross-sectional view taken along the line III to III of FIG. 3.

As shown in FIG. 2, the rotor $R_C$ is provided with a rotation shaft body 10, a plurality of moving blade members (blade bodies) 20, each of which includes the above-described moving blade 5, and a plurality of blade fixing pieces 30.

As shown in FIG. 1 or FIG. 2, the rotation shaft body 10 is constituted so as to assume a shaft shape as a whole by disk-like members being stacked coaxially in the turbine axial direction. As shown in FIG. 2 and FIG. 4, a blade groove 11 is formed at an outer circumference part 10A of the rotation shaft body 10. Moving blade members 20 are individually loaded into the blade groove 11 corresponding to the site at which the moving blade array 3 is disposed.

Figure 5:
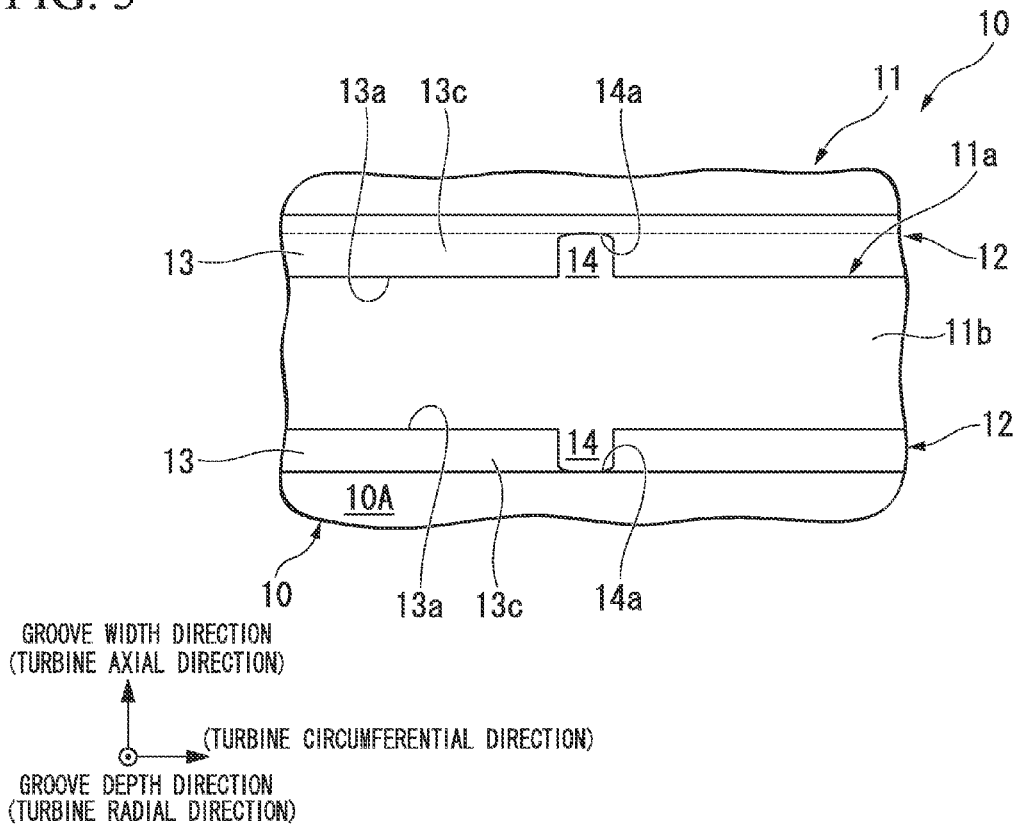
FIG. 5 is an enlarged plan diagram of major parts which shows a rotation shaft body 10 according to the first embodiment of the present invention and corresponds to FIG. 3.
Figure 6:
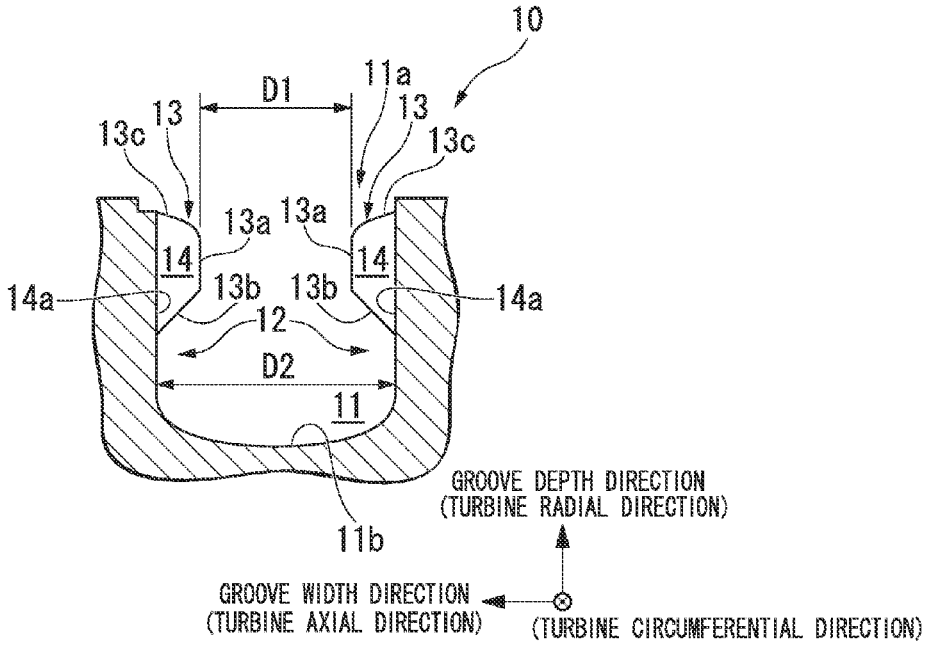
FIG. 6 is an enlarged sectional diagram of the major parts which shows the rotation shaft body 10 according to the first embodiment of the present invention and corresponds to FIG. 4.

FIG. 5 and FIG. 6 are views which show briefly a constitution of the rotation shaft body 10. FIG. 5 is an enlarged plan diagram of major parts and corresponds to FIG. 3. FIG. 6 is an enlarged sectional diagram of the major parts and corresponds to FIG. 4.

As shown in FIG. 5, each blade groove 11 extends in the turbine circumferential direction. Although not illustrated, each blade groove 11 is formed all across the circumference of the outer circumference part 10A. On both side walls 12, 12 which oppose each other in the groove width direction (turbine axial direction) of the blade groove 11, opening wall parts 13, 13 are formed on a blade opening 11 a side. Each of the opening wall parts 13, 13 projects to the inside in the groove width direction from the groove opening 11*a* side of the blade groove 11. That is, as shown in FIG. 6, a width dimension D1 on the groove opening 11*a* side of the blade groove 11 is set to be smaller than a width dimension D2 thereof on the groove bottom 11*b* side.

As shown in FIG. 6, the opening wall parts 13, 13 are provided with end faces 13*a*, 13*a*, each of which extends in the groove depth direction (turbine radial direction) of the blade groove 11 and opposes each other. These end faces 13*a*, 13*a* oppose each other in such a manner that a distance between them is width dimension D1. Further, lower parts 13*b*, 13*b* of the opening wall parts 13, 13 are chamfered. In other words, each of the opening wall parts 13, 13 is formed to give an inclined face outward in the groove width direction by degrees from the groove opening 11*a* side to the groove bottom 11*b* side. The inclined face is formed in continuation with each of the end faces 13*a*, 13*a* and a lower part of each of the both side walls 12, 12. Further, upper parts 13*c*, 13*c* of the opening wall parts 13, 13 are formed in a circular-arc shape so that an opening width gradually narrows from the outside to the inside in the groove width direction.

Each of the opening wall parts 13, 13 extends on the whole circumference in the turbine circumferential direction (refer to FIG. 2). Further, the opening wall parts 13, 13 are provided with notches (recessed parts) 14, 14 at a plurality of sites with intervals in the turbine circumferential direction.

As shown in FIG. 5 and FIG. 6, each of the notches 14, 14 is formed in a groove shape and also extends in the groove depth direction (turbine radial direction) of the blade groove 11. The notches 14, 14 communicatively connect a downside of the lower parts 13*b*, 13*b* of the opening wall parts 13, 13 and an upside of the upper parts 13*c*, 13*c* of the opening wall parts 13, 13. As shown in FIG. 5, these notches 14, 14 are formed in such a manner that a cross-sectional contour orthogonal to the groove depth direction of the blade groove 11 assumes a square. The notches 14, 14 are also formed in such a manner that end faces 14*a*, 14*a* in the groove width direction assume a circular-arc shape.

These notches 14, 14 are formed so as to oppose each other in the groove width direction of the blade groove 11.

In the opening wall parts 13, 13, a blade insertion hole 11*c* which opens widely so that a blade basement 22 of the moving blade member 20 can be inserted is formed at a position different from positions where the notches 14, 14 are formed. The blade basement 22 of the moving blade member 20 will be described later by referring to FIG. 11 and FIG. 12.

As shown in FIG. 6, the groove bottom 11*b* of the blade groove 11 is formed in a circular arc shape so as to be gradually increased in groove depth to inward in the groove width direction on a cross section orthogonal to the turbine circumferential direction.

As shown in FIG. 2, in the moving blade member 20, the above-described moving blade 5, a platform 21 leading to the base end of the moving blade 5 and the blade basement 22 leading to the platform 21 are formed from the outside to the inside in the turbine radial direction in the above-described order.

As shown in FIG. 3, the moving blade 5 is formed in a streamline shape so as to be orthogonal to the turbine radial direction. As shown in FIG. 3, the moving blade 5 is also formed in such a shape that a distal end side thereof in the turbine radial direction is twisted around the turbine radial direction with respect to the base end side.

As shown in FIG. 3, the platform 21 extends in the turbine radial direction so as to intersect and covers the blade groove 11. Further, the surface of the platform 21 leads to the base end of the moving blade 5. The platform 21 can be formed in a plate shape, for example. The platform 21 can be formed as a parallelogram when viewed from the outside to the inside in the turbine radial direction.

Further, in two moving blade members 20 (20A, 20B) which sandwich a blade fixing piece 30, an access hole 21*b* which has been penetrated in the turbine radial direction, as shown in FIG. 4, is defined by the end edges 21*a* of both the platforms 21 which are fitted in each other in the turbine circumferential direction as shown in FIG. 3.

As shown in FIG. 2, the blade basement 22 leads to the back of the platform 21 and is formed so as to gradually increase a dimension in the turbine axial direction to inside in the turbine radial direction on a cross section (not illustrated) orthogonal to the turbine circumferential direction.

The blade basement 22 is fitted into the groove bottom 11*b* side of the blade groove 11 shown in FIG. 6. The blade basement 22 allows one part of both side-parts thereof in the turbine axial direction to run along the lower parts 13*b*, 13*b* of the opening wall parts 13, 13.

As shown in FIG. 2, the blade fixing piece 30 is arranged between one set of adjacent two moving blade members 20 (20A, 20B) in the turbine circumferential direction inside the blade groove 11. In the present embodiment, a plurality of the blade fixing pieces 30 are disposed (for example, eight) at the positions corresponding to the notches 14, 14 in the turbine circumferential direction. Then, with regard to the blade fixing piece 30, a predetermined number of moving blade members 20 are positioned between adjacent two blade fixing pieces 30 in the circumferential direction. The blade fixing pieces 30 may not be disposed at an equal interval.

Figure 7:
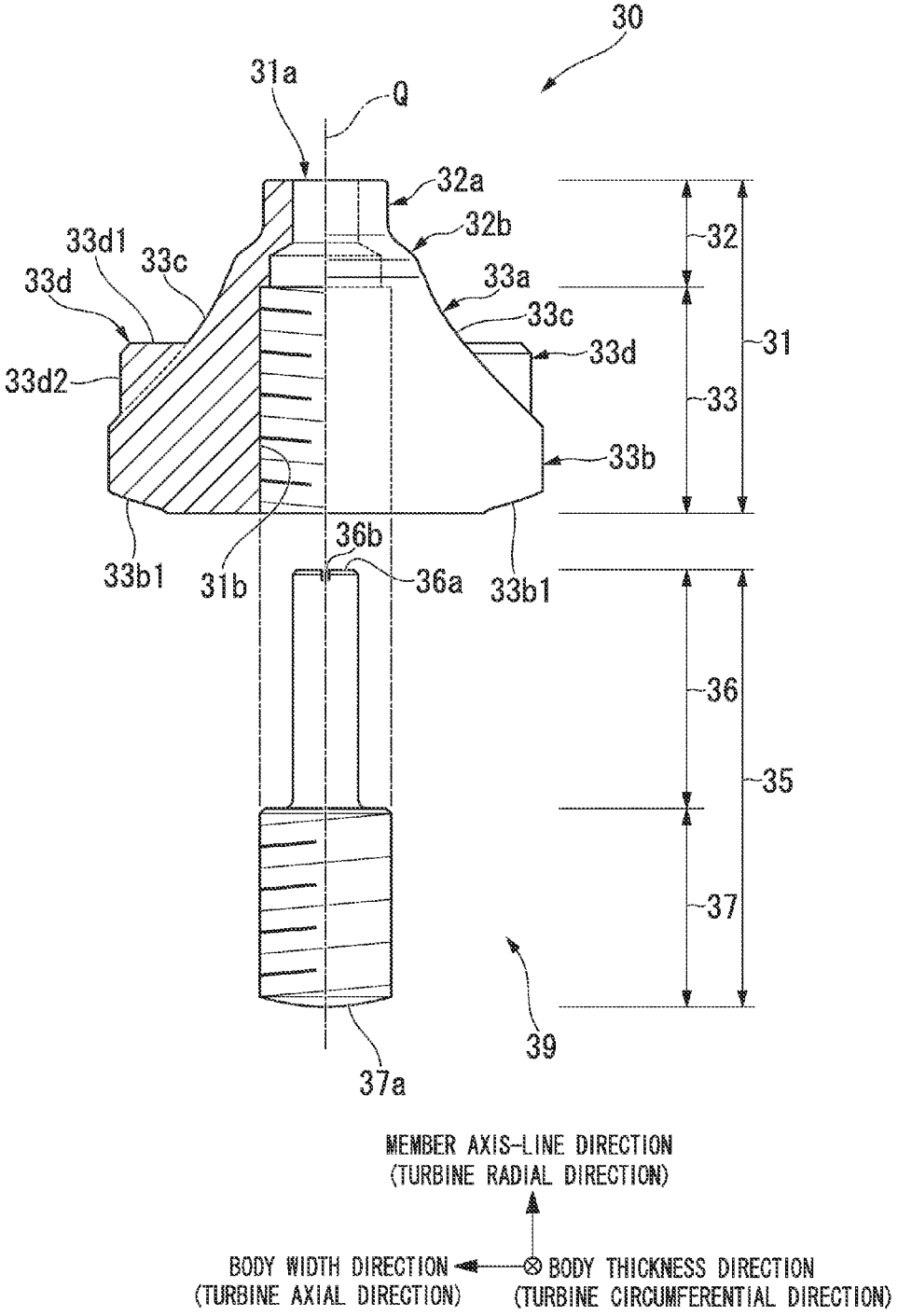
FIG. 7 is an exploded diagram when a blade fixing piece 30 according to the first embodiment of the present invention is viewed from the front and in which a piece main body 31 is shown in a half cross section.
Figure 8:
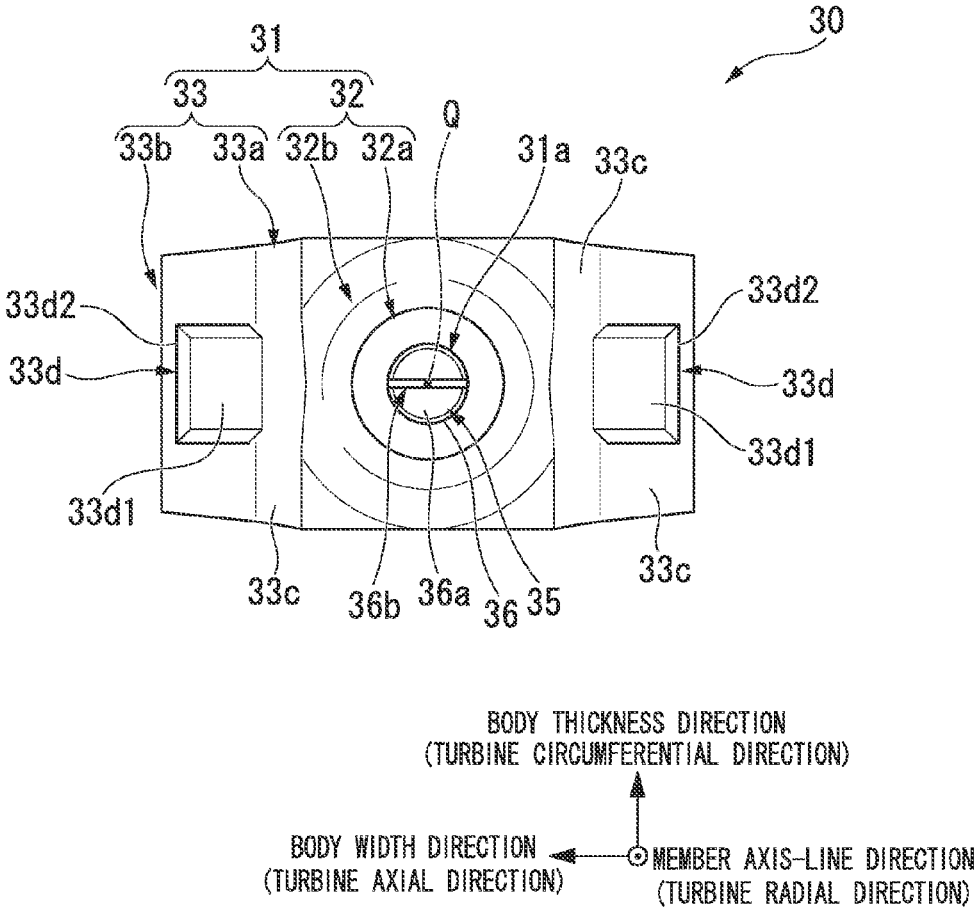
FIG. 8 is a plan diagram which shows the blade fixing piece 30 according to the first embodiment of the present invention.
Figure 9:
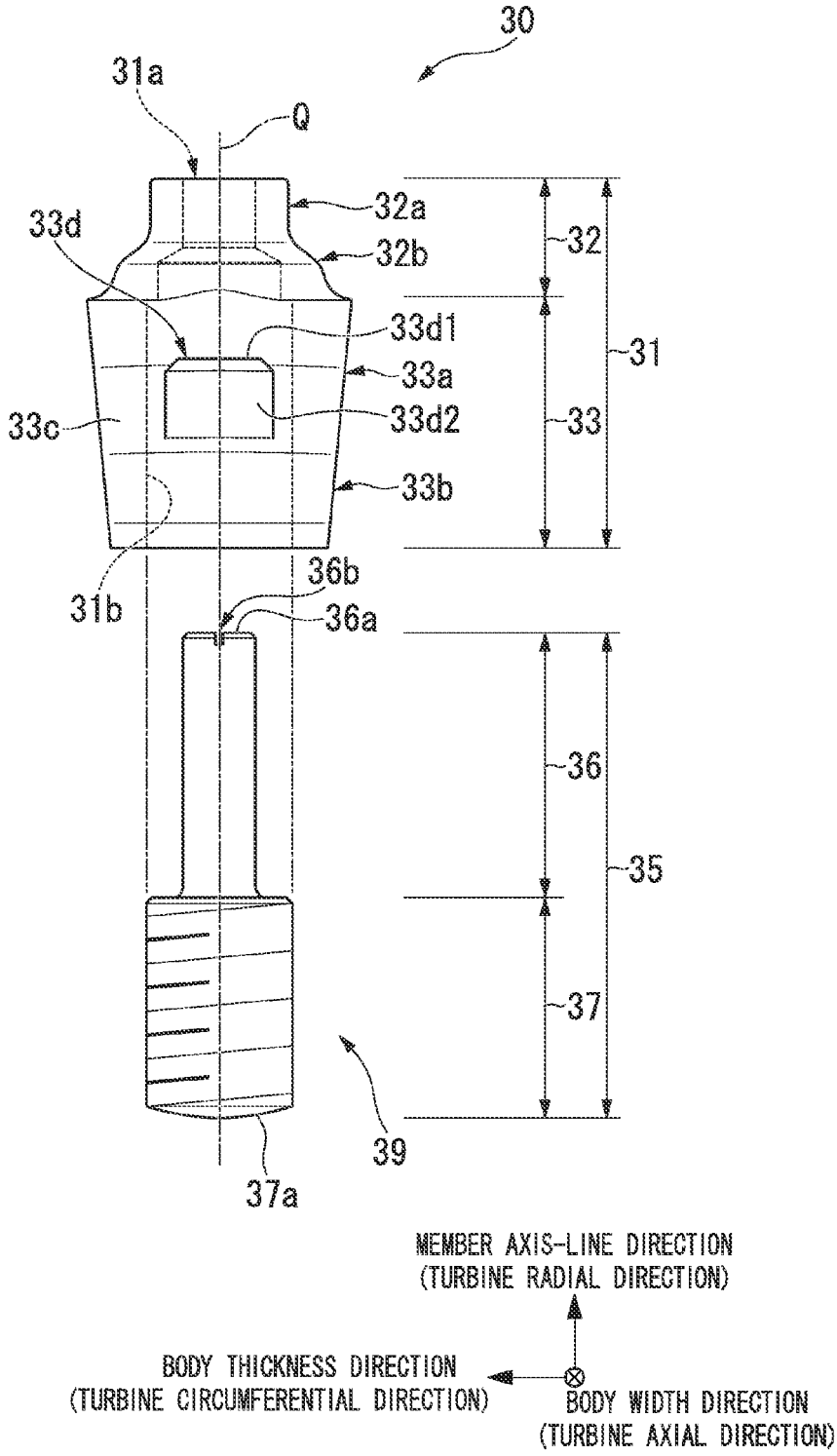
FIG. 9 is an exploded diagram when the blade fixing piece 30 according to the first embodiment of the present invention is viewed from the side face.

FIG. 7 is an exploded diagram when the blade fixing piece 30 is viewed from the front. FIG. 8 is a plan diagram which shows the blade fixing piece 30. FIG. 9 is an exploded diagram when the blade fixing piece 30 is viewed from the side face.

As shown in FIG. 7 to FIG. 9, the blade fixing piece 30 is provided with a piece main body 31 and an advance-retract axle 35.

As shown in FIG. 7 and FIG. 9, the piece main body 31 is a member having a through hole 31*a* formed on a member axis line Q of the blade fixing piece 30. The piece main body 31 is provided with a stepped cylinder part 32 and a body wall part 33. The stepped cylinder part 32 is formed at one end of the member axis-line direction which the member axis line Q extends (turbine radial direction). The body wall part 33 is formed at the other side of the member axis-line direction.

The stepped cylinder part 32 is provided with a neck part 32*a* and a shoulder part 32*b*. The neck part 32*a* is formed so as to be constant in diameter at one side in the member axis-line direction. The shoulder part 32*b* is formed in continuation with the neck part 32*a* and formed in such a shape that a part which gradually increases in diameter from one end to the other end in the member axis-line direction is set in two stages.

As shown in FIG. 7 and FIG. 9, the body wall part 33 is formed in continuation with the shoulder part 32*b*. Then, the body wall part 33 is formed in a flat hexagon in which a cross sectional shape orthogonal to the member axis-line direction shown in FIG. 8 is set in such a manner that the body thickness is thinner than the body width. This body wall part 33, as shown in FIG. 7, is provided with a tapered part 33*a* formed in continuation with the shoulder part 32*b* and a bottom part 33*b* formed in continuation with the tapered part 33*a* at the other side in the member axis-line direction.

As shown in FIG. 7, the tapered part 33*a* gradually increases so that cross sectional area of the flat hexagon enlarges the body width from one side to the other side in the member axis-line direction, as shown in FIG. 8.

As shown in FIG. 7, the bottom part 33*b* is formed in such a manner that the body width is substantially constant in dimension. Further, the bottom part 33*b* is formed so that corners of the both ends 33*b*1 of the bottom face in the body width direction are chamfered.

Tapered faces 33*c*, 33*c* which increase in width from one side to the other side in the member axis-line direction extend on both sides in the body width direction of the tapered part 33*a* of the body wall part 33.

Figure 10:
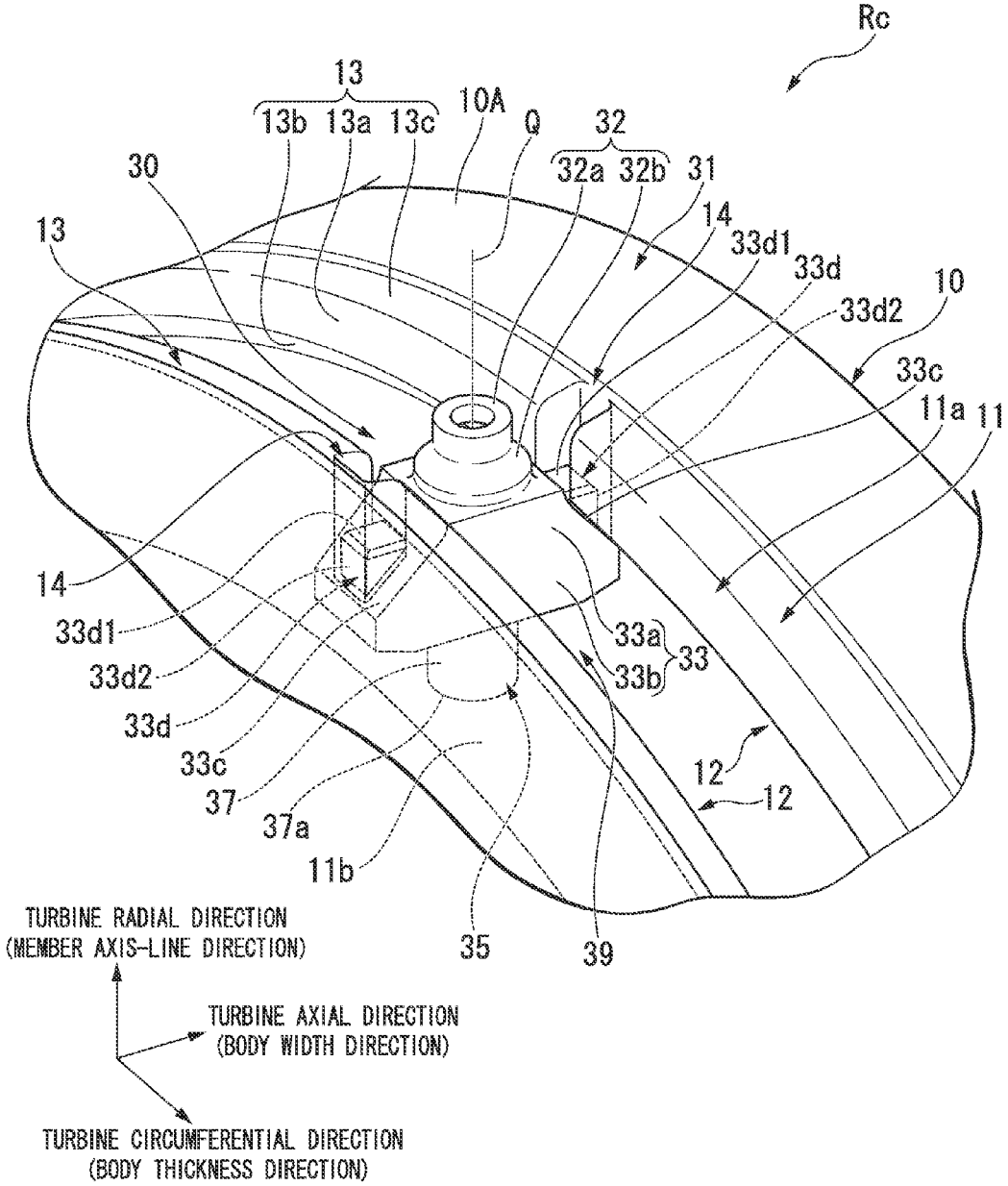
FIG. 10 is a perspective diagram which shows a usage state of the blade fixing piece 30 according to the first embodiment of the present invention. A moving blade member 20 is not illustrated in FIG. 10.

As shown in FIG. 10, the tapered faces 33*c*, 33*c* are formed so that curvature thereof is equal in curvature of the lower parts 13*b*, 13*b* of the opening wall parts 13, 13. Projection walls (projected parts) 33*d*, 33*d* projecting in the member axis-line direction and in the body width direction are formed respectively at the centers in the thickness direction of the tapered faces 33*c*, 33*c*.

Each of the projection walls 33*d*, 33*d* is formed in a triangular prism shape in which the bottom face assumes a right isosceles triangle with the perpendicular direction of the bottom face being directed to the body thickness direction. Each of the projection walls 33*d*, 33*d* causes the square face 33*d*, which is one of two square faces 33d1, 33d2 specifically formed substantially equal in dimension, to intersect in the member axis-line direction. Then, each of the projection walls 33*d*, 33*d* causes the other square face 33*d*2 to intersect in the body width direction of the piece main body 31. Further, corner edges of the square face 33*d*2 are chamfered.

The above-described through hole 31*a* is formed at the body wall part 33 so as to be constant in diameter. Further, the through hole 31*a* is formed at the stepped cylinder part 32 so as to be reduced in diameter at two stages. An internal thread part 31*b* is formed at a site of the body wall part 33 which is formed constant in diameter.

The advance-retract axle 35 is provided with a shaft part 36 and an external thread part 37. The shaft part 36 is formed at one side in the member axis-line direction so as to be relatively small in diameter. The external thread part 37 is formed at the other side in the member axis-line direction so as to be relatively large in diameter, with the outer circumference face thereof being threaded.

An engagement groove 36*b* with which a tool such as a slotted screwdriver can be engaged is formed at an end face 36*a* which is one side of the shaft part 36 in the member axis-line direction.

An end face 37*a* which is at the other side in the member axis-line direction of the external thread part 37 swells out to the other side of the member axis-line direction.

The external thread part 37 is screwed into the internal thread part 31*b* of the piece main body 31 by the advance-retract axle 35. Then, the advance-retract axle 35 is configured to be capable of being screwed into the piece main body 31 in the member axis-line direction. Further, when the advance-retract axle 35 is screwed into the other side in the member axis-line direction, the shaft part 36 is fitted into an opening of the through hole 31*a* of the stepped cylinder part 32.

As described above, the external thread part 37 of the advance-retract axle 35 is screwed into the internal thread part 31*b* of the piece main body 31, thereby constituting a displacement mechanism 39 which allows the piece main body 31 to advance and retract with respect to the groove bottom 11*b* of the blade groove 11 in the turbine radial direction.

FIG. 10 is a perspective diagram which shows a usage state of the blade fixing piece 30. In FIG. 10, the moving blade member 20 is not illustrated.

As shown in FIG. 10, the blade fixing piece 30 directs the member axis line Q of the blade fixing piece 30 in the turbine radial direction (blade depth direction) and also directs the body width direction in the turbine axial direction (groove width direction) at a site where each of the notches 14, 14 is formed. Then, the blade fixing piece 30 is restricted from being displaced in the turbine circumferential direction to the blade groove 11 by the projection walls 33*d*, 33*d* of the piece main body 31 are fitted into the notches 14, 14.

Further, the blade fixing piece 30 causes the end face 37*a* of the advance-retract axle 35 to make a point contact with the groove bottom 11*b* of the blade groove 11. Then, the blade fixing piece 30 is restricted in the turbine radial direction by receiving a reaction force that the advance-retract axle 35 receives from the groove bottom 11*b* of the blade groove 11 and a reaction force that the tapered faces 33*c*, 33*c* receive from the lower parts 13*b*, 13*b* of the opening wall parts 13, 13.

Next, a description will be given for some steps of assembly of the rotor $R_c$ mainly by referring to FIG. 11 to FIG. 16. From FIG. 11 to FIG. 16, the moving blade member 20 is omitted for illustration by indicating a contour of the platform 21 with a dashed line.

Figure 11:
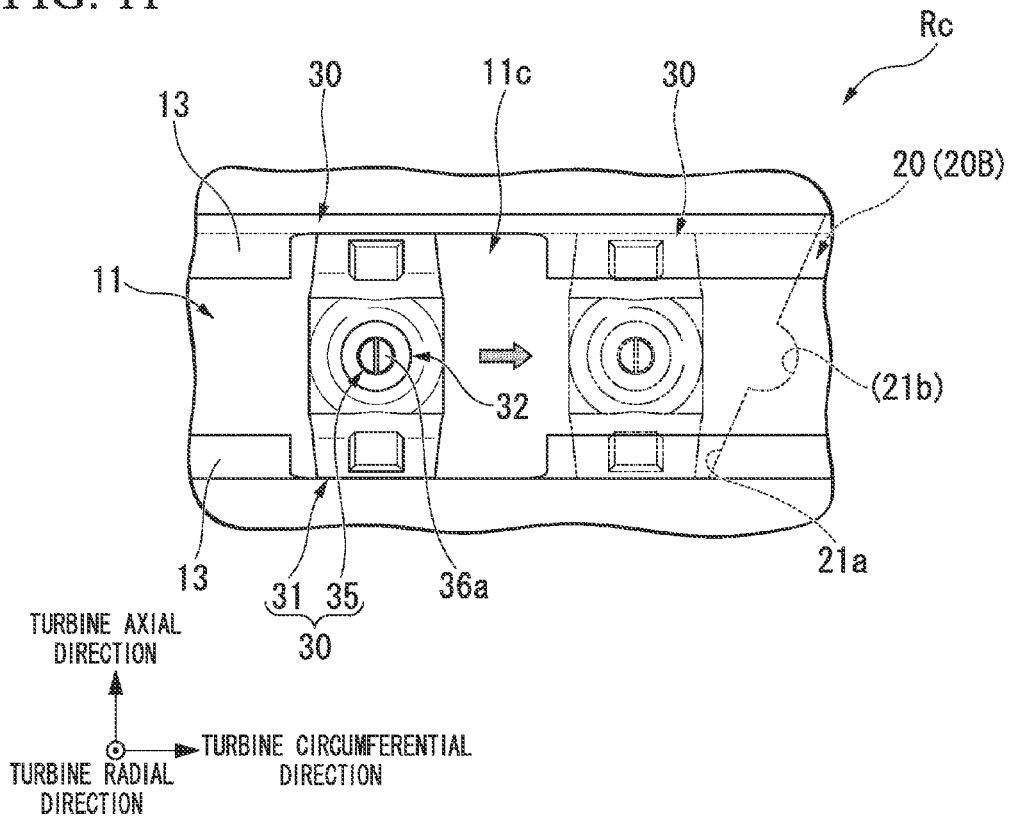
FIG. 11 is an explanation drawing of a first action according to the first embodiment of the present invention and corresponds to FIG. 3.
Figure 12:
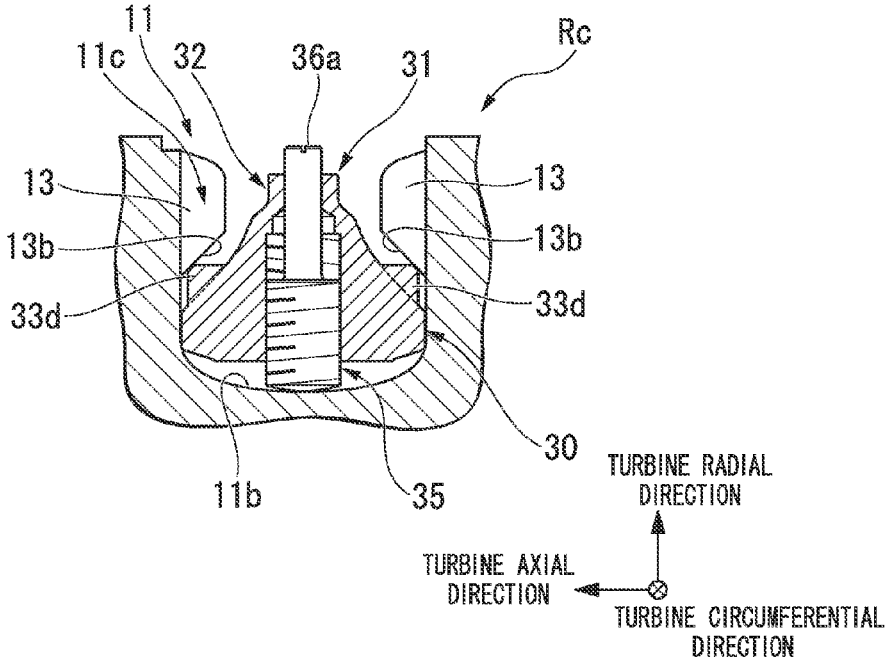
FIG. 12 is an explanation drawing of a second action according to the first embodiment of the present invention and corresponds to FIG. 4.

First, the blade basement 22 of the moving blade member 20 shown in FIG. 2 is inserted into the blade insertion hole 11*c* of the blade groove 11 shown in FIG. 11 and FIG. 12. Next, the blade basement 22 is fitted into a lower side of the blade groove 11 by the moving blade member 20 being caused to slide in the turbine circumferential direction.

Then, the moving blade member 20 is caused to slide in the turbine circumferential direction in a state where the blade basement 22 is fitted into the lower side of the blade groove 11. This operation is repeated for every moving blade members 20, thereby loading a predetermined number of moving blade members 20 into the blade groove 11. In this instance, a moving blade member 20 of the predetermined number of moving blade members 20, which is to be loaded last is one of the above-described moving blade members 20A, 20B (for example, the moving blade member 20B).

As shown in FIG. 11 and FIG. 12, after the predetermined number of moving blade members 20 are completely loaded into the blade groove 11, the blade fixing piece 30 is inserted into the blade insertion hole 11*c* of the blade groove 11.

As shown in FIG. 12, when the blade fixing piece 30 is inserted into the blade groove 11, the end face 36*a* of the advance-retract axle 35 is positioned outside from the stepped cylinder part 32 in the turbine radial direction. Further, in the blade fixing piece 30, the extent of projection of the advance-retract axle 35 from the piece main body 31 is small. To be more specific, the advance-retract axle 35 is set for its projection extent in such a manner that a gap is formed between the projection walls 33*d*, 33*d* on both sides of the piece main body 31 and the lower parts 13*b*, 13*b* of the opening wall parts 13, 13 in a state that the end face 37*a* of the advance-retract axle 35 is caused to make a point contact at least with the groove bottom 11*b* of the blade groove 11.

In this state, the blade fixing piece 30 is caused to slide in the turbine circumferential direction.

After the blade fixing piece 30 is caused to slide, the other of the moving blade members 20A, 20B (for example, the moving blade member 20B) is loaded into the blade insertion hole 11*c* of the blade groove 11 shown in FIG. 11 and FIG. 12. Accordingly, the access hole 21*b* is defined by both end edges 21*a* which are fitted in each other in the turbine circumferential direction of the moving blade members 20A, 20B. Further, as shown in FIG. 13, the end face 36*a* of the advance-retract axle 35 is exposed from the access hole 21*b*.

Figure 13:
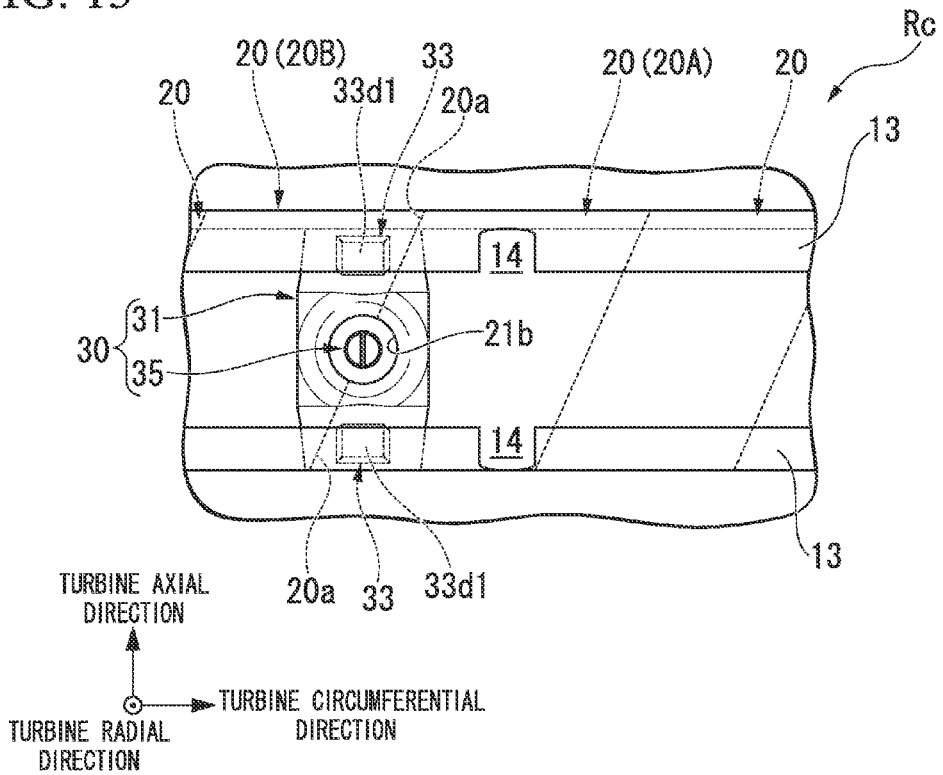
FIG. 13 is an explanation drawing of a third action according to the first embodiment of the present invention and corresponds to FIG. 3.
Figure 14:
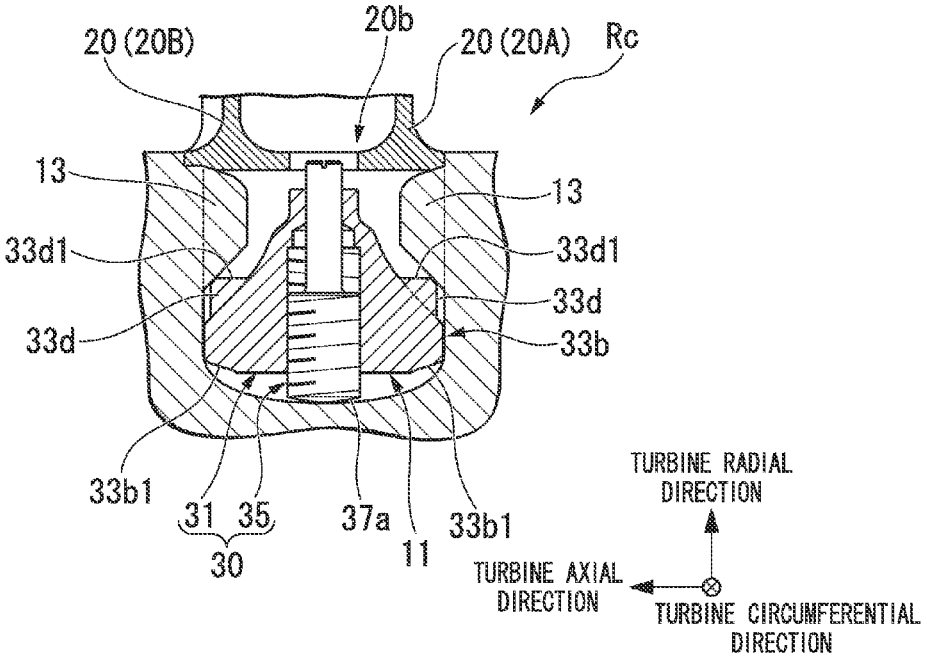
FIG. 14 is an explanation drawing of a fourth action according to the first embodiment of the present invention and corresponds to FIG. 4.

Then, as shown in FIG. 13 and FIG. 14, the blade fixing piece 30 inserted into the blade groove 11 is caused to slide in the turbine circumferential direction inside the blade groove 11 together with the moving blade member 20. In this instance, corner edges of the square face 33*d*1 on the projection wall 33*d* of the body wall part 33 and both ends 33*b*1 of the bottom part 33*b* of the piece main body 31 are chamfered, and the end face 37*a* of the shaft part 36 swells out. Therefore, the blade fixing piece 30 slides smoothly on an inner surface of the blade groove 11.

Figure 15:
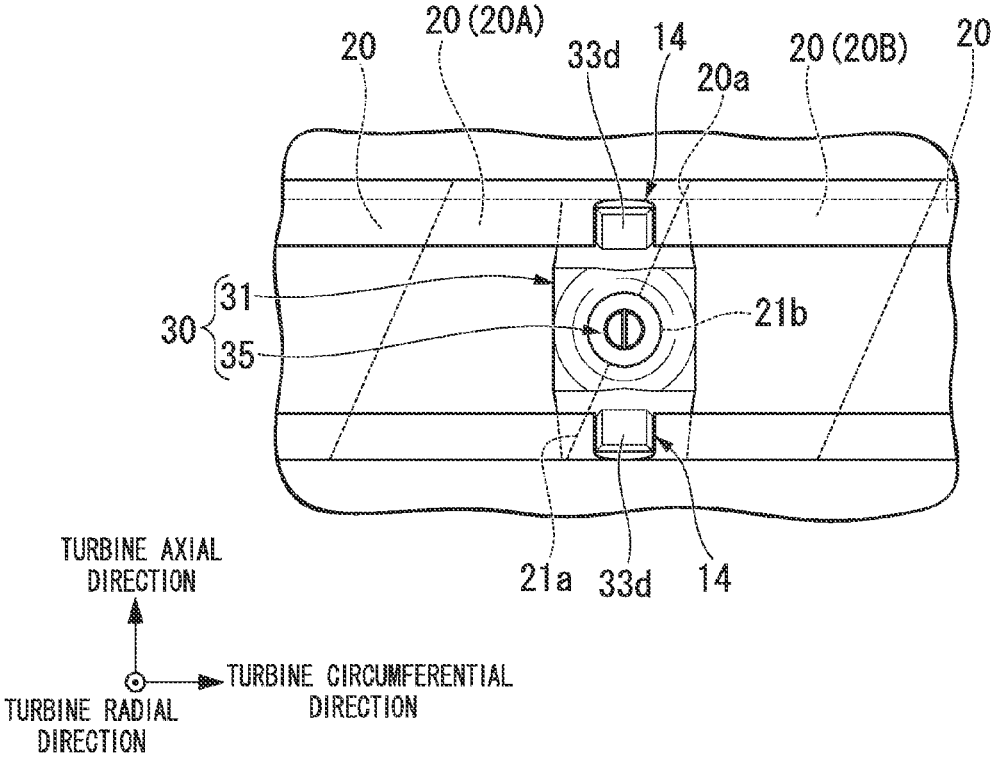
FIG. 15 is an explanation drawing of a fifth action according to the first embodiment of the present invention and corresponds to FIG. 3.

When the blade fixing piece 30 arrives at the notches 14, 14, as shown in FIG. 15, the projection walls 33*d*, 33*d* of the blade fixing piece 30 are arranged so as to overlap on the notches 14, 14 in the turbine radial direction.

Figure 16:
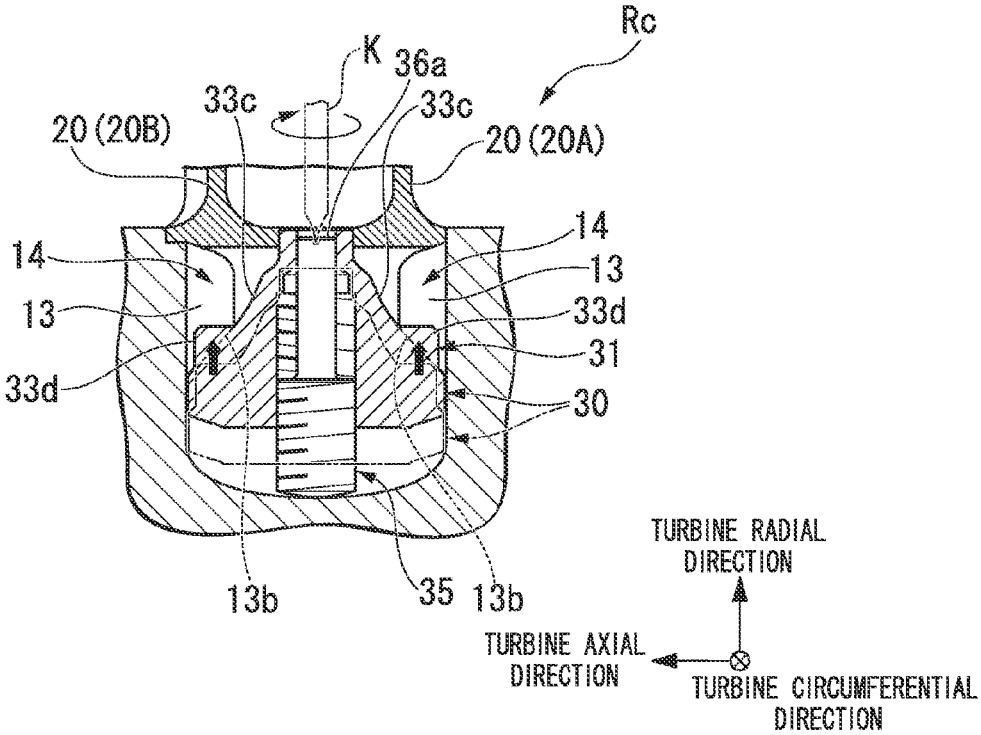
FIG. 16 is an explanation drawing of a sixth action according to the first embodiment of the present invention and corresponds to FIG. 4.

Then, as shown in FIG. 16, a tool K is engaged with the end face 36*a* of the shaft part 36, thereby causing the advance-retract axle 35 to move rotationally. Thus, the advance-retract axle 35 is screwed internally in the turbine radial direction into the piece main body 31. When the end face 37*a* of the advance-retract axle 35 makes a point contact with the groove bottom 11*b* of the blade groove 11, the piece main body 31 undergoes a relative displacement outward in the turbine radial direction so as to be spaced away from the groove bottom 11*b*.

Further, when the piece main body 31 is increased in relative displacement amount with respect to the groove bottom 11*b*, the projection walls 33*d*, 33*d* are fitted into the notches 14, 14. And, the tapered faces 33*c*, 33*c* come into contact with the lower parts 13*b*, 13*b* of the opening wall parts 13, 13.

In addition, the advance-retract axle 35 is caused to move rotationally, thereby restricting a relative displacement between the piece main body 31 and the advance-retract axle 35. At this time, the advance-retract axle 35 receives a reaction force from the groove bottom 11*b* of the blade groove 11, and also the tapered faces 33*c*, 33*c* receive a reaction force from the lower parts 13*b*, 13*b* of the opening wall parts 13, 13.

Accordingly, the blade fixing piece 30 is restricted from being displaced with respect to the blade groove 11.

That is, the projection walls 33*d*, 33*d* of the blade fixing piece 30 interfere with the notches 14, 14 of the opening wall parts 13, 13, thereby restricting the blade fixing piece 30 in the turbine circumferential direction. Then, the advance-retract axle 35 receives the reaction force from the groove bottom 11*b* of the blade groove 11, and also the tapered faces 33*c*, 33*c* receive the reaction force from the lower parts 13*b*, 13*b* of the opening wall parts 13, 13. As a result, the blade fixing piece 30 is fixed in the turbine radial direction.

After all the moving blade members 20 are loaded into the blade groove 11, two moving blade members 20 apart by a half pitch are positioned at the blade insertion hole 11*c* of the blade groove 11 shown in FIG. 11 and FIG. 12. Further, a spacer member is inserted between these two moving blade members 20, thereby blocking the blade insertion hole 11*c* of the blade groove 11.

In the above-formed rotor $R_c$, displacement of the moving blade member 20 in the turbine circumferential direction is restricted by the blade fixing piece 30. That is, the projection walls 33*d*, 33*d* of the blade fixing piece 30 interfere with the notches 14, 14 of the opening wall parts 13, 13, thereby restricting the moving blade member 20 from being displaced in the turbine circumferential direction.

Here, upon actuation of the gas turbine GT, for example, an outer circumference part 10A of the rotation shaft body 10 is exposed to a high-temperature working fluid (compressed air) to cause a difference in temperature between the inside and the outside of the rotation shaft body 10. In this instance, a differential thermal expansion between the outside and the inside of the rotation shaft body 10 will cause a thermal stress. However, since no structurally discontinuous part is formed on the groove bottom 11*b* of the blade groove 11, stress is less likely to concentrate on the groove bottom. Therefore, for example, it would be hard to cause a crack on the groove bottom 11*b* of the blade groove 11 even though repeating actuation of the gas turbine GT.

Then, since the notches 14, 14 are positioned on the surface of the rotation shaft body 10, they are more easily increased in temperature than the groove bottom 11*b*. Further, a difference in temperature is hard to take place on the surface of the rotation shaft body 10, and thermal stress is relatively small. As a result, even when stress is concentrated on the notches 14, 14, it would be quite short in duration of time and the stress would be relatively low in intensity. Therefore, cracks are hard to occur at the notches 14, 14 which are structurally discontinued parts.

Even if cracks occur on the notches 14, 14, the cracks will advance from the notches 14, 14 to the surface of the outer circumference part 10A of the rotation shaft body 10.

As described above, according to the present embodiment, the projection walls 33*d*, 33*d* are formed on the blade fixing piece 30, and the notches 14, 14 which are fitted into the projection walls 33*d*, 33*d* are formed at the opening wall parts 13, 13 of the blade groove 11. Therefore, a relative displacement in the turbine circumferential direction of the moving blade member 20 with respect to the blade groove 11 is restricted by interference between the projection walls 33*d*, 33*d* and the notches 14, 14. As a result, stress is hard to concentrate on the groove bottom 11*b* of the blade groove 11, thus making it possible to avoid the occurrence of cracks on the groove bottom 11*b* of the blade groove 11.

In a conventional rotor structure, when a crack occurs on the groove bottom 11*b* of the blade groove 11 in a state where the moving blade member 20 is assembled to the rotation shaft body 10, it is difficult to find the crack during ordinary maintenance and inspection. As a result, the crack progresses excessively or breaks the rotation shaft body 10 by the crack, thus resulting in the fear that it may be necessary to stop operation of a compressor C into which the rotation shaft body 10 has been assembled. Further, the conventional rotor structure is also inferior in maintainability because even when a crack occurring on the groove bottom 11*b* of the blade groove 11 is found, it is difficult to repair the rotation body assembled unless the moving blade member 20 is detached.

However, according to the present embodiment, there is no possibility that a crack occurs on the groove bottom 11*b* of the blade groove 11. Further, even if a crack has occurred on the opening wall part 13, 13 of the blade groove 11, a site of the crack is positioned on the surface of the outer circumference 10A of the rotation shaft body 10. Thus, the crack can be found easily. As a result, it is possible to prevent breakage of the rotation shaft body 10 resulting from the crack. It is, thereby, possible to operate stably and continuously the compressor C into which the rotation shaft body 10 is assembled. Still further, since the site of the crack is positioned on the surface side of the outer circumference 10A of the rotation shaft body 10, repairs can also be done relatively easily.

Further, according to the present embodiment, in a state where fitting between the projection walls 33*d*, 33*d* and the notches 14, 14 is cancelled, the blade fixing piece 30 is allowed to slide on the blade groove 11 in the turbine circumferential direction. Thereby, upon assembling the moving blade member 20 and the blade fixing piece 30 to the rotation shaft body 10, the blade fixing piece 30 is caused to slide on the groove bottom 11*b* side of the blade groove 11 and can be arranged at a desired position. It is, thereby, possible to improve process workability in which the moving blade members 20 and the blade fixing pieces 30 are assembled to the rotation shaft body 10.

Further, according to the present embodiment, the projection walls 33*d*, 33*d* projecting from the tapered faces 33*c*, 33*c* in the turbine radial direction and in the turbine axial direction are fitted into the notches 14, 14 extending in the turbine radial direction. Thereby, in a state where the projection walls 33*d*, 33*d* are fitted into the notches 14, 14, the blade fixing piece 30 can be reliably restricted in the turbine circumferential direction.

Further, according to the present embodiment, the displacement mechanism 39 causes the piece main body 31 on which the projection walls 33*d*, 33*d* are formed to advance and retract with respect to the groove bottom 11*b* of the blade groove 11, thereby the projection walls 33*d*, 33*d* and the notches 14, 14 can be removably fit. Therefore, the projection walls 33*d*, 33*d* and the notches 14, 14 can be removably fitted easily. It is, thereby, possible to improve the workability in which the moving blade members 20 and the blade fixing pieces 30 are assembled to the rotation shaft body 10.

Further, according to the present embodiment, the advance-retract axle 35 can be screwed into the groove bottom 11*b* of the blade groove 11. Thereby, the piece main body 31 is caused to advance and retract with respect to the groove bottom 11*b* of the blade groove 11 accurately and easily in a relatively simple constitution.

Still further, according to the present embodiment, the end face 36*a* on which the engagement groove 36*b* has been formed is exposed outside from the access hole 21*b*. Thereby, a tool K such as a slotted screwdriver can be easily engaged therewith and also the advance-retract axle 35 is caused to move rotationally more easily. Thereby, it is possible to displace the advance-retract axle 35 quite easily.

In addition, according to the present embodiment, the end face 37*a* of the advance-retract axle 35 swells out to the groove bottom 11*b* of the blade groove 11. Thereby, the end face 37*a* of the advance-retract axle 35 on which the external thread part 37 has been formed is caused to make a point contact with the groove bottom 11*b* of the blade groove 11.

Thereby, the end face 37*a* of the advance-retract axle 35 on which the external thread part 37 has been formed is prevented from making a partial contact with the groove bottom 11*b* of the blade groove 11 and caused to reliably make a point contact therewith. As a result, the piece main body 31 is caused to more reliably advance and retract with respect to the groove bottom 11*b* of the blade groove 11.

Further, in the present embodiment, in particular, the groove bottom 11*b* of the blade groove 11 is formed so as to be recessed in a circular-arc shape on a cross section orthogonal to the turbine circumferential direction. However, the end face 37*a* of the advance-retract axle 35 is caused to swell out to the groove bottom 11*b*, by which the end face 37*a* is caused to more reliably make a point contact with the groove bottom 11*b*.

Further, according to the present embodiment, the blade fixing piece 30 is provided with the tapered faces 33*c*, 33*c* which are in contact with the opening wall parts 13, 13 of the blade groove 11 from the groove bottom 11*b* of the blade groove 11. It is, thereby, possible to successfully restrict the blade fixing piece 30 in the turbine radial direction.

Still further, according to the present embodiment, each of the tapered faces 33*c*, 33*c* is formed in such a shape taken along each of the lower parts 13*b*, 13*b* of the opening wall parts 13, 13. Thereby, various sites of the tapered faces 33*c*, 33*c* can be pressed uniformly to the lower parts 13*b*, 13*b*. As a result, the various sites of the tapered faces 33*c*, 33*c* receive a uniform reaction force from the lower parts 13*b*, 13*b*. It is, therefore, possible to restrict more reliably the blade fixing piece 30 in the turbine radial direction.

In addition, according to the present embodiment, the blade fixing piece 30 is provided with the projection walls

33*d*, 33*d*, and the notches 14, 14 are formed at the opening wall parts 13, 13 of the blade groove 11. It is, therefore, possible to avoid the occurrence of cracks on the groove bottom 11*b* of the blade groove 11 in a relatively simple constitution.

[Second Embodiment]

Hereinafter, a description will be given for the second embodiment of the present invention by referring to drawings. In the following description and the drawings used for the description, constituents similar to those which have been already described will be given the same reference numerals, with overlapping descriptions being omitted.

Figure 17:
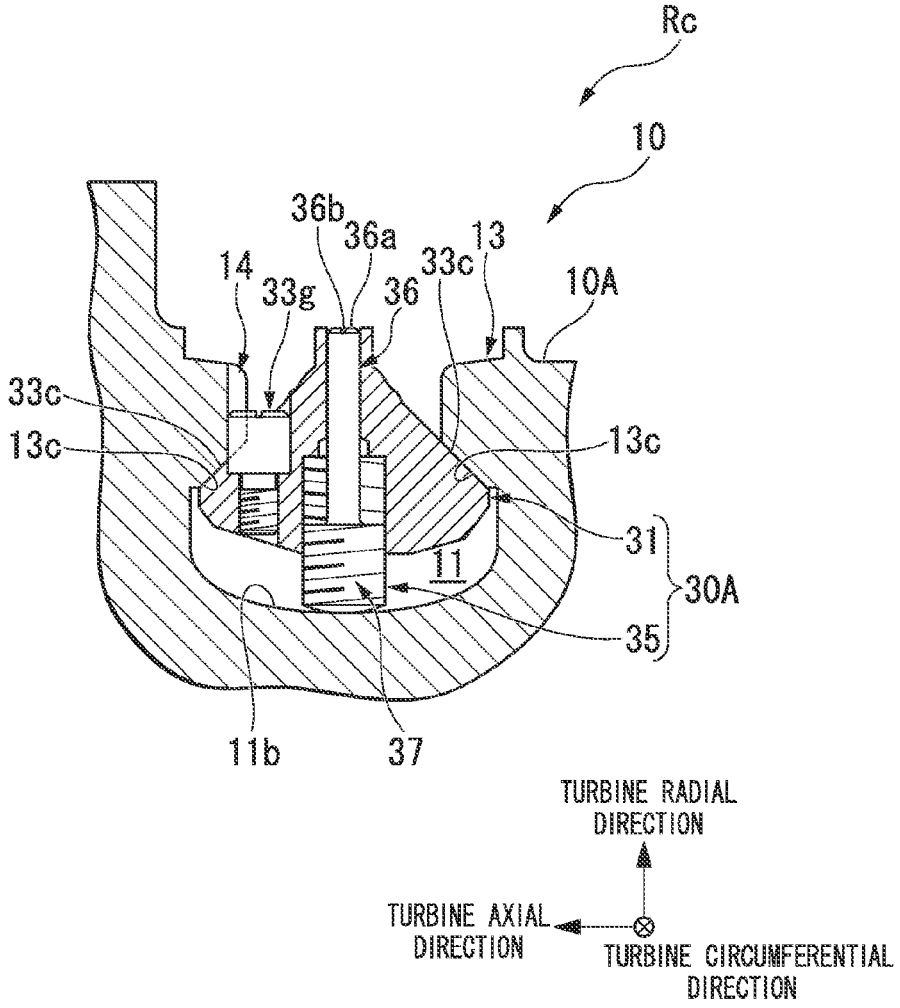
FIG. 17 is a sectional diagram of major parts which shows a brief constitution of a blade fixing piece 30A according to a second embodiment of the present invention.

FIG. 17 is a sectional diagram of major parts which shows a brief constitution of a blade fixing piece 30A according to the second embodiment of the present invention.

In the above-described first embodiment, the two projection walls 33*d*, 33*d* are formed on the tapered faces 33*c*, 33*c* of the blade fixing piece 30. On the other hand, as shown in FIG. 17, in the blade fixing piece 30A of the second embodiment, no projection walls 33*d*, 33*d* are provided, and a screw member (projected part) 33*g* is provided in a projecting manner on one of the tapered faces 33*c* of tapered faces 33*c*, 33*c* in the turbine axial direction.

Further, in the above-described first embodiment, the two notches 14, 14 are formed at the opening wall parts 13, 13 of the blade groove 11. On the other hand, in the second embodiment, at the opening wall parts 13, 13, a notch 14 is formed only at one of opening wall part 13 in the turbine axial direction.

In the constitution of the present embodiment, the same effect as that of the above-described first embodiment can be obtained. In addition, for example, even when it is difficult to secure the strength of the projection wall 33*d* of the first embodiment or form the projection walls 33*d*, 33*d* due to design requirements such as shape and dimensions, a site to be arranged and a material of the blade fixing piece 30A, various design requirements can be met by using the screw member 33*g* which is separate from the blade fixing piece 30A according to the constitution of the present embodiment.

Further, according to the present embodiment, even when the screw member 33*g* is broken, the screw member 33*g* can be exchanged without detaching the blade fixing piece 30A from the blade groove 11. Therefore, repairs can be done quickly, and operation of a compressor C can be thereby restored immediately.

Operation procedures shown in the above-described embodiments or various shapes and combinations of individual constituents are just examples. They may be modified in various ways on the basis of design requirements or the like in a scope not departing from the scope of the present invention.

For example, the notch 14 of the opening wall part 13 and the projection wall 33*d* (screw member 33*g*) of the blade fixing piece 30 (30A) may be fitted with each other, thereby restricting a relative movement of the blade fixing piece 30 with respect to the blade groove 11. It is, therefore, possible to adopt a shape other than the shapes described above.

Further, in the above-described embodiments, a grove sectional contour is defined by the opening wall parts 13, 13 and the groove bottom 11*b* having a circular-arc cross section. However, if the width dimension of the groove opening 11*a* side of the blade groove 11 is set to be smaller than the width dimension of the groove bottom 11*b* side of the blade groove 11, there may be adopted another groove sectional contour. For example, the opening wall parts 13, 13 may be formed in a rectangular shape when viewed from the cross section, or the groove bottom 11*b* may be formed in the shape of a flat face.

Still further, in the above-described embodiments, the projection walls 33*d* formed at the blade fixing piece 30 and the notches 14, 14 formed at the opening wall parts 13, 13 are caused to be fitted. However, it is acceptable that recessed parts are formed at the blade fixing piece 30, projected parts are formed at the opening wall parts 13, 13, and they are fitted with each other.

In addition, in the above-described embodiments, the present invention is applied to the moving blade 5 of the compressor C. The present invention may be, however, applied to the moving blade of the turbine T. In the above-described embodiments, the present invention is applied to a gas turbine. However, the present invention may be applied to other rotary machines such as a steam turbine.

A description has been so far given for preferred embodiments of the present invention, to which the present invention shall not be, however, limited. The present invention may be subjected to addition, omission, and replacement of the constitution and other modifications within a scope not departing from the scope of the present invention. The present invention shall not be restricted to the above description but will be restricted only by the scope of the attached claims.

What is claimed is:

1. A rotor structure, comprising:

a rotation shaft body in which a blade groove is formed at an outer circumference part rotating around an axis line, and extends in a circumferential direction of the axis line, and a width dimension of a groove opening side of the blade groove is set to be smaller than a width dimension of a groove bottom side of the blade groove; and a plurality of blade bodies which are arrayed in the circumferential direction at the outer circumference part of the rotation shaft body and have blade basements of which is fitted into the blade groove respectively;

wherein a blade fixing piece is installed so as to be a positioned between at least one set of adjacent two blade bodies in the circumferential direction inside the blade groove, one of an opening wall part of the groove opening side of the blade groove and the blade fixing piece is provided with a projected part, and the other of them is provided with a recessed part which is fitted into the projected part, the blade fixing piece is provided with a screw member as the projected part which projects in the radial direction of the axis line at least one side in the width direction of the blade groove, and the opening wall part of the blade groove is provided with a notch as the recessed part which extends in the radial direction at least one side in the width direction of the blade groove.

2. The rotor structure according to claim 1, wherein the blade fixing piece is allowed to slide in the circumferential direction on the blade groove in a state of fitting of the projected part into the recessed part is cancelled.

3. The rotor structure according to claim 1, wherein the projected part projects in a radial direction of the axis line, and the recessed part extends in the radial direction.

4. The rotor structure according to claim 1, wherein the blade fixing piece includes a piece main body on which the projected part or the recessed part is formed, and a displacement mechanism which causes the piece main body to advance and retract with respect to the groove bottom of the blade groove in the radial direction of the axis line to allow the projected part and to removably fit to the recessed part.

5. The rotor structure according to claim 4, wherein the displacement mechanism comprises:

a through hole which penetrates in the radial direction through the piece main body and has at least partially an internal thread part; and an advance-retract axle which has at least partially an external thread part screwed into the internal thread part and which can be screwed into the groove bottom of the blade groove.

6. The rotor structure according to claim 1, wherein the blade fixing piece includes a contact part which is in contact with the opening wall part of the blade groove from the groove bottom of the blade groove.

7. The rotor structure according to claim 1, wherein the blade fixing piece is provided with a projection wall as the projected part which projects in the radial direction of the axis line at least one side in the width direction of the blade groove, and the opening wall part of the blade groove is provided with a notch as the recessed part which extends in the radial direction at least one side in the width direction of the blade groove.

8. The rotor structure according to claim 5, wherein an end face of the advance-retract axle that faces the groove bottom of the blade groove swells out to the groove bottom of the blade groove.

* * * * *